US011603729B2

(12) United States Patent
Liu et al.

(10) Patent No.: US 11,603,729 B2
(45) Date of Patent: Mar. 14, 2023

(54) SINGLE-TUBE DOUBLE-WELLHEAD DRILLING AND PRODUCTION APPARATUS

(71) Applicants: Hainan Energy Limited, CNOOC, Haikou (CN); Shanghai Xiawei Petroleum Equipment Technical Service Co., Ltd, Shanghai (CN)

(72) Inventors: Shujie Liu, Haikou (CN); Yi Huang, Haikou (CN); Dawei Gong, Shanghai (CN); Xia Fan, Shanghai (CN); Hexing Liu, Haikou (CN); Wenbo Meng, Haikou (CN)

(73) Assignees: Hainan Energy Limited, CNOOC, Haikou (CN); Shanghai Xiawei Petroleum Equipment Technical Service Co., Ltd, Shanghai (CN)

( * ) Notice: Subject to any disclaimer, the term of this patent is extended or adjusted under 35 U.S.C. 154(b) by 0 days.

(21) Appl. No.: 17/709,664

(22) Filed: Mar. 31, 2022

(65) Prior Publication Data

US 2022/0325593 A1 Oct. 13, 2022

(30) Foreign Application Priority Data

Apr. 13, 2021 (CN) ..... 202110393726.6

(51) Int. Cl.
*E21B 33/04* (2006.01)
*E02D 5/24* (2006.01)
(Continued)

(52) U.S. Cl.
CPC ..... *E21B 33/04* (2013.01); *E02D 5/24* (2013.01); *E21B 17/1078* (2013.01); *E21B 34/00* (2013.01); *E21B 43/128* (2013.01)

(58) Field of Classification Search
CPC ..... E21B 33/04; E21B 17/1078; E21B 34/00; E21B 43/128; E02D 5/24
See application file for complete search history.

(56) References Cited

U.S. PATENT DOCUMENTS 4,886,121 A * 12/1989 Demny ..... E21B 33/04 166/85.1
6,192,981 B1 * 2/2001 Boquet ..... E21B 19/10 188/67
(Continued)

*Primary Examiner* — Yong-Suk (Philip) Ro
(74) *Attorney, Agent, or Firm* — Andrus Intellectual Property Law, LLP

(57) ABSTRACT

A single-tube double-wellhead drilling and production apparatus is provided, which includes a suction pile, two first wellhead heads, two second wellhead heads, two second guiding pipes, two tubings, two tubing hangers, and two plugs located inside and connected with a corresponding second wellhead head. Each second wellhead head is connected to a corresponding first wellhead head and is connected through a connecting pipeline which is provided with a control valve and a check valve. One end of each first wellhead head is connected with a corresponding first guiding pipe connected with the suction pile. Each second guiding pipe is located inside a corresponding first guiding pipe and is connected to an end of a corresponding second wellhead head. Each tubing hanger is located in and connected with a corresponding second wellhead head, is located below and communicates with a corresponding plug, end of which is provided with a corresponding tubing.

6 Claims, 3 Drawing Sheets

(51) Int. Cl.

| | |
|---|---|
| ***E21B 17/10*** | (2006.01) |
| ***E21B 34/00*** | (2006.01) |
| ***E21B 43/12*** | (2006.01) |

(56) References Cited

U.S. PATENT DOCUMENTS

| | | | | |
|---|---|---|---|---|
| 7,455,105 | B1 * | 11/2008 | McKee | E21B 17/20 166/77.2 |
| 8,511,393 | B2 * | 8/2013 | Nguyen | E21B 33/0422 166/382 |
| 2008/0185156 | A1 * | 8/2008 | Rodgers | E21B 33/04 166/75.13 |
| 2014/0238693 | A1 * | 8/2014 | Adkinson | E21B 33/04 166/382 |
| 2015/0275610 | A1 * | 10/2015 | Tan | E21B 33/04 166/85.4 |
| 2018/0163499 | A1 * | 6/2018 | Powell | E21B 33/035 |
| 2018/0179838 | A1 * | 6/2018 | Nguyen | E21B 33/04 |
| 2018/0320471 | A1 * | 11/2018 | Jackson | E21B 33/0407 |
| 2022/0341314 | A1 * | 10/2022 | Arab | E21B 33/06 |

* cited by examiner

SINGLE-TUBE DOUBLE-WELLHEAD DRILLING AND PRODUCTION APPARATUS

CROSS REFERENCE TO RELATED APPLICATION

This patent application claims the benefit and priority of Chinese Patent Application No. 202110393726.6 filed on Apr. 13, 2021, the disclosure of which is incorporated by reference herein in its entirety as part of the present application.

TECHNICAL FIELD

The present disclosure relates to the field of new energy exploitation technologies, in particular, to a single-tube double-wellhead drilling and production apparatus.

BACKGROUND ART

Energy sources refer to resources that can provide energy. With the development of economy, that people exploit the energy of land has entered a bottleneck. At the same time, in order to meet requirement of people for clean energy, energy exploitation is gradually turned to deep sea. During the energy exploitation, on the one hand, conventional oil and natural gas are the main sources, and on the other hand, cleaner energy sources are also being sought, such as the exploitation of hydrates.

China has been at the forefront of the world about the exploration and exploitation of hydrates. A large number of hydrates have been discovered in the deep sea regions of South China Sea. Due to the special conditions under which the hydrates exist, it is very difficult for people to exploit them.

SUMMARY

(1) Purpose of the Disclosure

To solve the above technical problems, the present disclosure provides a single-tube double-wellhead drilling and production apparatus, which can realize the joint exploitation of two wells, increase the exploitation yield, improve installation efficiency, and greatly reduce the cost of new energy exploitation.

(2) Technical Solutions

The present disclosure provides the single-tube double-wellhead drilling and production apparatus including a suction pile, two first wellhead heads, two second wellhead heads, two first guiding pipes, two second guiding pipes, two tubings, a plurality of first locking devices, two tubing hangers, two plugs, two second locking devices and a connecting pipeline.

Each of the two second wellhead heads is extended into a corresponding one of the two first wellhead heads, the each of the two second wellhead heads is connected to an inner wall of the corresponding one of the two first wellhead heads; one end of each of the two first wellhead heads is connected with a corresponding one of the two first guiding pipes; the two first guiding pipes extend into the suction pile and are connected with the suction pile.

Each of the two second guiding pipes is located inside a corresponding one of the two first guiding pipes, and one end of each of the two second guiding pipes is connected to an end of a corresponding one of the two second wellhead heads.

Each of the two plugs is located inside a corresponding one of the two second wellhead heads, and is connected with an inner wall of the corresponding one of the two second wellhead heads through a respective one of the plurality of second locking devices.

Each of the two tubing hangers is located inside another corresponding one of the two second wellhead heads, connected with an inner wall of the another corresponding one of the two second wellhead heads through a respective one of the plurality of first locking devices, and located below a corresponding one of the two plugs; the each of the two tubing hangers communicates with the corresponding one of the two plugs which are configured to install with a plurality of first sensors and a plurality of first chemical pipelines, and is provided with an electric submersible pump configured for producing hydrate, a plurality of second sensors and a plurality of second chemical pipelines.

Each of the two tubings is located in a corresponding one of the two second guiding pipes, and one end of the each of the two tubings is connected with a lower end port of a corresponding one of the two tubing hangers.

Each end of the connecting pipeline is connected with a corresponding one of the two second wellhead heads and communicates with a respective one of the two tubing hangers, and the connecting pipeline is provided with a control valve and a check valve.

In some embodiments, the apparatus may further include two production casings. Each of the two production casings may be located inside a corresponding one of the two first guiding pipes, and one end of the each of the two production casings may be connected with an other end of a corresponding one of the two second guiding pipes.

In some embodiments, the apparatus may further include two quick joints. Each of the two quick joints may be connected with a corresponding one of the two plugs.

In some embodiments, the apparatus may further include a plurality of stiffener plates. A side of each of the plurality of stiffener plates may be connected with a corresponding one of two first guiding pipes, and an other side of the each of the plurality of stiffener plates may be connected with the suction pile.

In some embodiments, the apparatus may further include a plurality of diagonal bracing plates, a centralizing rib plate and two centralizing rings.

Each of the two centralizing rings may be connected with a corresponding one of the two first guiding pipes and may be sleeved on an outside of the corresponding one of the two first guiding pipes, the two centralizing rings may be connected with the centralizing rib plate. The centralizing rib plate may be located inside the suction pile and connected with an inner wall of the suction pile.

An end of each of the plurality of diagonal bracing plates may be connected with an outer peripheral surface of a corresponding one of the two first guiding pipes, and an other end of the each of the plurality of diagonal bracing plates may be connected with the centralizing rib plate and the inner wall of the suction pile.

In some embodiments, the apparatus may further include a main control assembly. The main control assembly, the check valve and the control valve may be electrically connected.

Compared with the prior art, the above technical solutions of the present embodiments have the following beneficial technical effects.

The single-tube double-wellhead drilling and production apparatus provided by the present disclosure can realize the installation of two wellheads together on the same suction pile, thereby realizing the joint exploitation of the two wells. The apparatus can realize the simultaneous exploitation of hydrates in two wells, and can also realize the joint exploitation of hydrates and shallow gas in the two wells.

The single-tube double-wellhead drilling and production apparatus provided by the present disclosure can increase the exploitation yield. When the apparatus is in use, one of the two wells can be used as a production well, and the other well can be used as a well to stimulate hydrate yield, so as to increase the exploitation yield.

The single-tube double-wellhead drilling and production apparatus provided by the present disclosure improves the installation efficiency and greatly reduces the exploitation cost. When the apparatus is in use, production testing equipment or production Christmas tree equipment can be installed on the wellheads to realize long-term exploitation, thereby meeting the demand for new energy exploitation.

Figure 1:
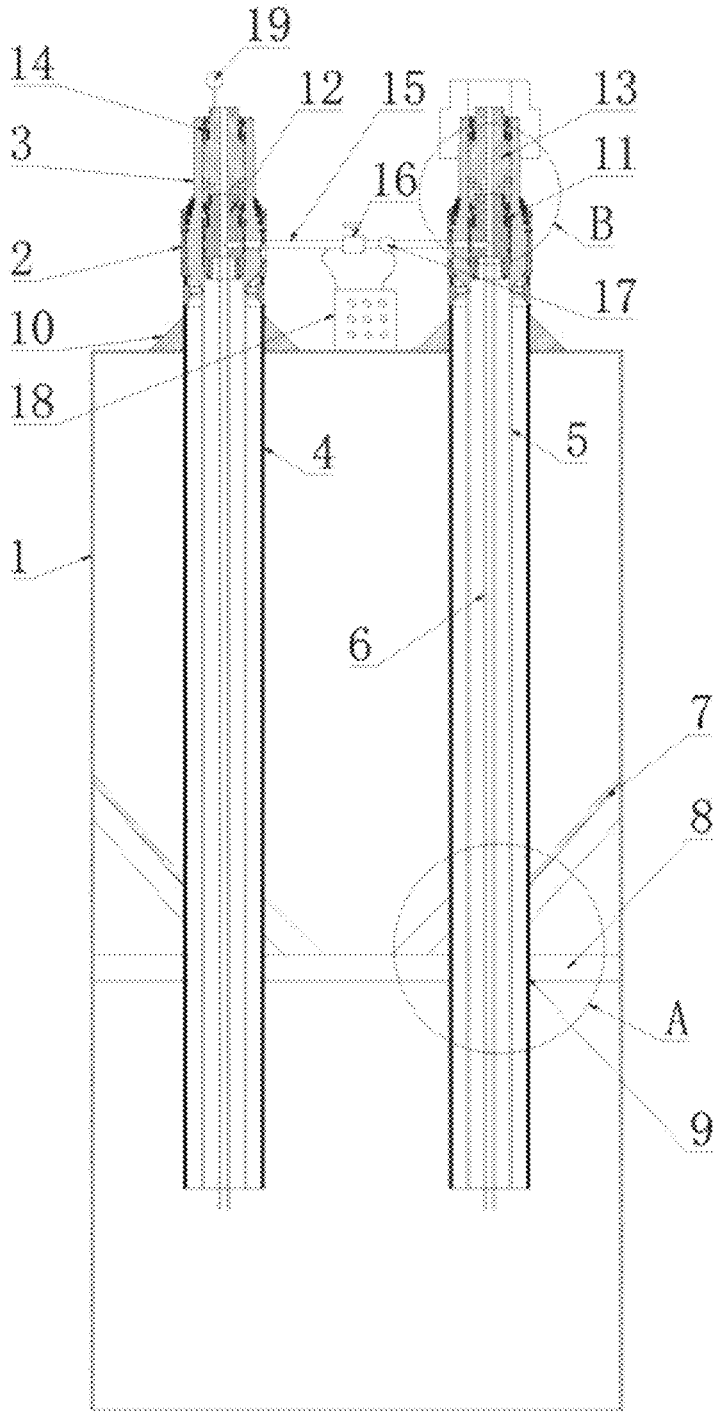
FIG. 1 is a schematic structural diagram of a single-tube double-wellhead drilling and production apparatus according to the present disclosure.

List of the reference characters: 1 suction pile; 2 first wellhead head; 3 second wellhead head; 4 first guiding pipe; 5 second guiding pipe; 6 tubing; 7 diagonal bracing plate; 8 centralizing rib plate; 9 centralizing ring; 10 stiffener plate; 11 first locking device; 12 tubing hanger; 13 plug; 14 second locking device; 15 connecting pipeline; 16 control valve; 17 check valve; 18 main control assembly; and 19 quick joint.

DETAILED DESCRIPTION OF THE EMBODIMENTS

In order to make the purpose, technical solutions and advantages of the present disclosure clearer, the present disclosure will be described in further detail below in conjunction with specific embodiments and with reference to the accompanying drawings. It should be understood that these descriptions are exemplary only and are not intended to limit the scope of the disclosure. Moreover, descriptions of well-known structures and techniques in the following description are omitted to avoid unnecessarily obscuring the concepts of the present invention.

Figure 2:
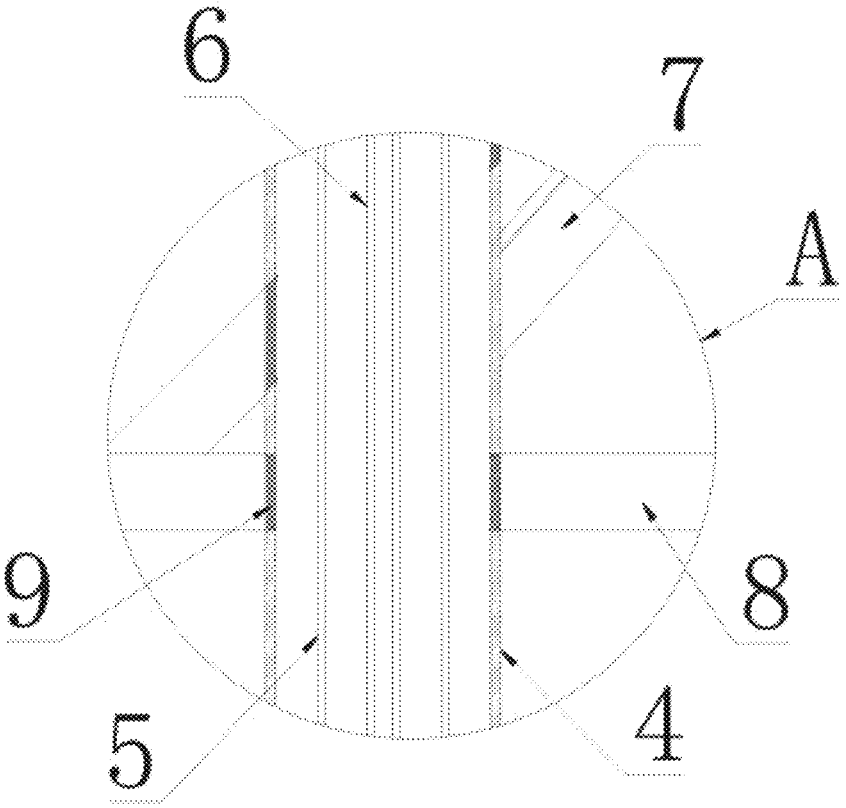
FIG. 2 is partial enlarged schematic diagram of a portion A of the single-tube double-wellhead drilling and production apparatus according to the present disclosure.
Figure 3:
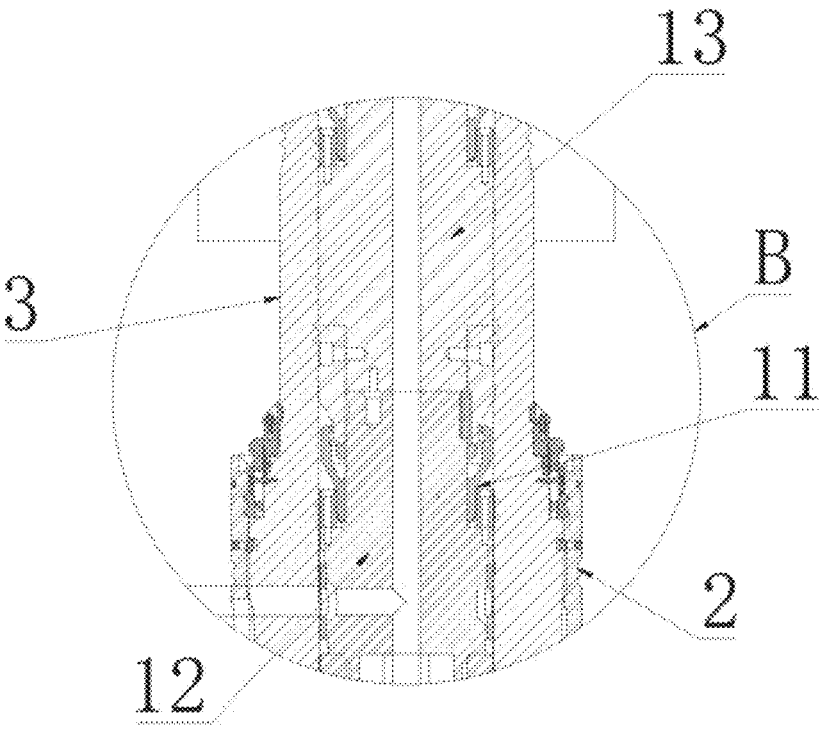
FIG. 3 is partial enlarged schematic diagram of a portion B of the single-tube double-wellhead drilling and production apparatus according to the present disclosure.

As shown in FIG. 1 to FIG. 3, the present embodiment provides a single-tube double-wellhead drilling and production apparatus, which includes a suction pile 1, two low-pressure wellhead heads (i.e., first wellhead heads) 2, two high-pressure wellhead heads (i.e., second wellhead head) 3, two first guiding pipes 4, two second guiding pipes 5, two tubings 6, multiple first locking devices 11, two tubing hangers 12, two plugs 13, two second locking devices 14 and a connecting pipeline 15.

Each of the two high-pressure wellhead heads 3 is extended into a corresponding one of the two low-pressure wellhead heads 2. The each of the two high-pressure wellhead heads 3 is connected to an inner wall of the corresponding one of the two low-pressure wellhead heads 2. One end of each of the two low-pressure wellhead heads 2 is connected with a corresponding one of the two first guiding pipes 4. The two first guiding pipes 4 extend into the suction pile 1, and are connected with the suction pile 1.

Each of the two second guiding pipes 5 is located inside a corresponding one of the two first guiding pipes 4. One end of each of the two second guiding pipes 5 is connected to an end of a corresponding one of the two high-pressure wellhead heads 3.

Each of the two plugs 13 is located inside a corresponding one of the two high-pressure wellhead heads. The each of the two plugs 13 is connected with an inner wall of the corresponding one of the two high-pressure wellhead heads 3 through a respective one of the second locking devices 14.

Each of the two tubing hangers 12 is located in another corresponding one of the two high-pressure wellhead heads 3. The each of the two tubing hangers 12 is connected with an inner wall of the another corresponding one of the two high-pressure wellhead heads 3 through a respective one of multiple first locking devices 11. The each of the two tubing hangers 12 is located below a corresponding one of the two plugs 13. The each of the two tubing hangers 12 communicates with the corresponding one of the two plugs 13 which are configured to install with multiple first sensors and multiple first chemical pipelines. The each of the two tubing hangers 12 is provided with an electric submersible pump configured for producing hydrate, multiple second sensors and multiple second chemical pipelines. The multiple first sensors, the multiple first chemical agent pipelines, the multiple second sensors and the multiple second chemical agent pipelines are all connected with a main control assembly 18.

Each of the two tubings 6 is located in a corresponding one of the two second guiding pipes 5. One end of the each of the two tubings 6 is connected with a lower end port of a corresponding one of the two tubing hangers 12. The hydrates enter a collecting device through the two tubings 6.

Each end of the connecting pipeline 15 is connected with a corresponding one of the two high-pressure wellhead heads 3, and communicates with a corresponding one of the two tubing hangers 12. The connecting pipeline 15 is provided with a control valve 16 and a check valve 17.

In a preferred embodiment, the apparatus further includes two production casings. Each of the two production casings is located inside a corresponding one of the two first guiding pipes 4. One end of the each of the two production casings is connected with an other end of a corresponding one of the two second guiding pipes 5.

In a preferred embodiment, the apparatus further includes two quick joints 19. Each of the two quick joints 19 is connected with a corresponding one of the two plugs 13.

The each of the two quick joints 19 is connected with the corresponding one of the two plugs 13 to facilitate the operation of the underwater robot.

In a preferred embodiment, the apparatus further includes multiple stiffener plates 10. A side of each of the multiple stiffener plates 10 is connected with a corresponding one of two first guiding pipes 4, and an other side of the each of the multiple stiffener plates 10 is connected with the suction pile 1.

When the apparatus is in use, the multiple stiffener plates 10 are arranged to improve the stability of the connection among the two first guiding pipes 4 and the suction pile 1. A projection shape of the each of the multiple stiffener plates 10 is a triangle.

In a preferred embodiment, the apparatus further includes multiple diagonal bracing plates 7, a centralizing rib plate 8 and two centralizing rings 9.

Each of the two centralizing rings 9 is connected with a corresponding one of the two first guiding pipes 4. The each of the two centralizing rings 9 is sleeved on an outside of the corresponding one of the two first guiding pipes 4. The two centralizing rings 9 are connected with the centralizing rib plate 8. The centralizing rib plate 8 is located inside the suction pile 1 and connected with an inner wall of the suction pile 1.

An end of each of the multiple diagonal bracing plates 7 is connected with an outer peripheral surface of a corresponding one of the two first guiding pipes 4, and an other end of the each of the multiple diagonal bracing plates 7 is connected with the centralizing rib plate 8 and the inner wall of the suction pile 1.

When the apparatus is in use, the two first guiding pipes 4 are subjected to bending-resistance and centralized by arranging the centralizing rib plate 8 and the multiple diagonal bracing plates 7, so as to improve the stability of the two first guiding pipes 4.

In a preferred embodiment, the apparatus further includes a main control assembly 18. The main control assembly 18, the check valve 17 and the control valve 16 are electrically connected.

In this embodiment, the drilling and production operation of one of the two wells is completed first during the new energy exploitation operation. Before the equipment is used, the tubing hangers 12, the tubings 6 and the plugs 13 are installed in place correspondingly, and then the operation on the main well of the two wells is carried out. The main well is used to develop and produce hydrates. During the operation on the main well, in order to prevent the unexpected passage of oil and gas in the wells, the control valve 16 on the connecting pipeline 15 between the two wells is closed first. After the operation is completed, the control valve 16 is opened to increase the production yield.

The apparatus can exploit the two wells at the same time, and can also exploit oil and gas with different properties. The main working principle of the apparatus is as follows. When the suction pile is introduced downwardly, the two wellheads fixed on the suction pile are introduced downwardly and simultaneously, and then drilling equipment is introduced downwardly, so as to perform the operation on the two wells separately. A lower part of each wellhead can be connected with the second guiding pipe 5 in a predetermined orientation. After the suction pile 1 is in place, the drilling operation can be carried out according to the predetermined orientation. After the installation of one well is completed, the installation of the other well may be carried out. After the operation on the two wells is completed, the control valve 16 on the connecting pipeline 15 between the two wells can be opened. The switch of the control valve is adjusted according to the pressure at a bottom of each well to maximize exploitation yield. The drilling equipment can be connected to an upper part of the wellhead for production testing, and production equipment can also be connected to this upper part for long-term exploitation, so as to meet the demand for new energy exploitation.

It should be understood that the above-mentioned specific embodiments of the present disclosure are only used to exemplary illustration or explain the principles of the present disclosure, and not to limit the present disclosure. Therefore, any modifications, equivalent replacements and improvements made without departing from the spirit and scope of the present disclosure should be included within the protection scope of the present disclosure. Furthermore, the appended claims of the disclosure are intended to cover all changes and modifications that fall within the scope and boundaries of the appended claims, or the equivalents of such scope and boundaries.

What is claimed is:

1. A single-tube double-wellhead drilling and production apparatus, comprising a suction , two first wellhead heads, two second wellhead heads, two first guiding pipes, two second guiding pipes, two tubings, a plurality of first locking devices, two tubing hangers, two plugs, two second locking device and a connecting pipeline;

wherein each of the two second wellhead heads is extended into a corresponding one of the two first wellhead heads, the each of the two second wellhead heads is connected to an inner wall of the corresponding one of the two first wellhead heads; one end of each of the two first wellhead heads is connected with a corresponding one of the two first guiding pipes; the two first guiding pipes extend into the suction pile and are connected with the suction pile;

each of the two second guiding pipes is located inside a corresponding one of the two first guiding pipes, and one end of each of the two second guiding pipes is connected to an end of a corresponding one of the two second wellhead heads;

each of the two plugs is located inside a corresponding one of the two second wellhead heads, and is connected with an inner wall of the corresponding one of the two second wellhead heads through a respective one of the plurality of second locking devices;

each of the two tubing hangers is located inside another corresponding one of the two second wellhead heads, connected with an inner wall of the another corresponding one of the two second wellhead heads through a respective one of the plurality of first locking devices, and located below a corresponding one of the two plugs; the each of the two tubing hangers communicates with the corresponding one of the two plugs which are configured to install with a plurality of first sensors and a plurality of first chemical pipelines, and is provided with an electric submersible pump configured for producing hydrate, a plurality of second sensors and a plurality of second chemical pipelines;

each of the two tubings is located in a corresponding one of the two second guiding pipes, and one end of the each of the two tubings is connected with a lower end port of a corresponding one of the two tubing hangers;

each end of the connecting pipeline is connected with a corresponding one of the two second wellhead heads and communicates with a respective one of the two tubing hangers, and the connecting pipeline is provided with a control valve and a check valve.

2. The single-tube double-wellhead drilling and production apparatus according to claim 1, further comprising two production casings; wherein each of the two production casings is located inside a corresponding one of the two first guiding pipes, and one end of the each of the two production casings is connected with an other end of a corresponding one of the two second guiding pipes.

3. The single-tube double-wellhead drilling and production apparatus according to claim 1, further comprising two quick joints; wherein each of the two quick joints is connected with a corresponding one of the two plugs.

4. The single-tube double-wellhead drilling and production apparatus according to claim 1, further comprising a plurality of stiffener plates; wherein a side of each of the plurality of stiffener plates is connected with a corresponding one of two first guiding pipes, and an other side of the each of the plurality of stiffener plates is connected with the suction pile.

5. The single-tube double-wellhead drilling and production apparatus according to claim 1, further comprising a plurality of diagonal bracing plates, a centralizing rib plate and two centralizing rings;

wherein each of the two centralizing rings is connected with a corresponding one of the two first guiding pipes and is sleeved on an outside of the corresponding one of the two first guiding pipes, the two centralizing rings are connected with the centralizing rib plate; and the centralizing rib plate is located inside the suction pile and connected with an inner wall of the suction pile;

an end of each of the plurality of diagonal bracing plates is connected with an outer peripheral surface of a corresponding one of the two first guiding pipes, and an other end of the each of the plurality of diagonal bracing plates is connected with the centralizing rib plate and the inner wall of the suction pile.

6. The single-tube double-wellhead drilling and production apparatus according to claim 1, further comprising a main control assembly; wherein the main control assembly, the check valve and the control valve are electrically connected.

* * * * *